US012703903B2

(12) United States Patent
Hinckley

(10) Patent No.: US 12,703,903 B2
(45) Date of Patent: Aug. 11, 2026

(54) ALLOY FOR HIGH-STRESS GOUGING ABRASION

(71) Applicant: Weir Minerals Australia Ltd, Artarmon (AU)

(72) Inventor: Brook Hinckley, Carlingford (AU)

(73) Assignee: Weir Minerals Australia Limited, Artarmon (AU)

( * ) Notice: Subject to any disclaimer, the term of this patent is extended or adjusted under 35 U.S.C. 154(b) by 591 days.

(21) Appl. No.: 17/774,324

(22) PCT Filed: Nov. 6, 2020

(86) PCT No.: PCT/AU2020/051217
§ 371 (c)(1),
(2) Date: May 4, 2022

(87) PCT Pub. No.: WO2021/087576
PCT Pub. Date: May 14, 2021

(65) Prior Publication Data

US 2022/0389550 A1 Dec. 8, 2022

(30) Foreign Application Priority Data

Nov. 7, 2019 (AU) ..... 2019904197

(51) Int. Cl.
*C22C 38/38* (2006.01)
*C21D 1/60* (2006.01)
(Continued)

(52) U.S. Cl.
CPC ..... *C22C 38/38* (2013.01); *C21D 1/60* (2013.01); *C21D 6/002* (2013.01); *C21D 6/005* (2013.01);
(Continued)

(58) Field of Classification Search
CPC ..... C22C 38/38; C22C 33/006; C22C 33/04; C22C 38/001; C22C 38/22; C22C 38/04;
(Continued)

(56) References Cited

U.S. PATENT DOCUMENTS 4,394,168 A 7/1983 Hartvig et al.
9,273,385 B2 * 3/2016 Dolman ..... C22C 37/10
(Continued)

FOREIGN PATENT DOCUMENTS

CN 104884661 A 9/2015
CN 109338233 A 2/2019
(Continued)

OTHER PUBLICATIONS

Crucible Industries, "Heat Treatment Of Tool Steels"; https://www.crucible.com/eselector/general/generalpart2.html; 2010, retrieved from internet on Feb. 14, 2023 (Feb. 14, 2023); 4 pages.

*Primary Examiner* — Sally A Merkling
*Assistant Examiner* — Nazmun Nahar Shams
(74) *Attorney, Agent, or Firm* — Morriss O'Bryant Compagni Cannon, PLLC

(57) ABSTRACT

The present invention relates to a manganese steel alloy having a heat-treated micro structure comprising an alloy composition, an austenitic ferrous matrix, and formed refractory particles dispersed throughout the austenitic ferrous matrix such that at least 10% of the formed refractory particles are located within crystallites of the austenitic ferrous matrix, as opposed to being located at grain boundaries between the crystallites, and a method of producing the manganese steel alloy.

15 Claims, 2 Drawing Sheets

(51) Int. Cl.

| | |
|---|---|
| ***C21D 6/00*** | (2006.01) |
| ***C22C 33/00*** | (2006.01) |
| ***C22C 33/04*** | (2006.01) |
| ***C22C 38/00*** | (2006.01) |
| ***C22C 38/22*** | (2006.01) |

(52) U.S. Cl.
CPC ..... *C22C 33/006* (2013.01); *C22C 33/04* (2013.01); *C22C 38/001* (2013.01); *C22C 38/22* (2013.01); *C21D 2211/001* (2013.01)

(58) Field of Classification Search
CPC ..... C22C 38/12; C21D 1/60; C21D 6/002; C21D 6/005; C21D 2211/001; C21D 2211/004
See application file for complete search history.

(56) References Cited

U.S. PATENT DOCUMENTS

| | | | | |
|---|---|---|---|---|
| 11,566,308 | B2 * | 1/2023 | Kim | C21D 9/0062 |
| 2009/0308499 | A1 | 12/2009 | Scott et al. | |

FOREIGN PATENT DOCUMENTS

| | | | |
|---|---|---|---|
| EP | 3561120 | A1 | 10/2019 |
| JP | H0790496 | A | 4/1995 |
| JP | 2016507648 | A1 | 3/2016 |
| KR | 20150015594 | A | 11/2015 |
| WO | 1984001175 | A1 | 3/1984 |
| WO | 2011091479 | A1 | 8/2011 |
| WO | 2019186911 | A1 | 10/2019 |

* cited by examiner

ALLOY FOR HIGH-STRESS GOUGING ABRASION

FIELD OF THE INVENTION

The present invention relates to metal alloys for high-stress gouging abrasion applications, in particular to manganese steels.

The invention has been developed primarily for mining equipment liners, in particular crusher liners, and will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

Manganese steels are typically comprised of about 12 wt % manganese, 1.2 wt % carbon and a remaining balance of iron, additives, and incidental impurities, and are widely used in applications which require high impact resistance and/or high resistance to abrasion. A property of manganese steels that make them particularly suitable for these applications is their capacity to work-harden when repeatedly subjected to stress. However, during this work-hardening process, the manganese steel is subjected to high levels of strain in a relatively soft state and may experience undesirable deformation during the early stages of operation before sufficient work-hardening is achieved.

Some metallurgists have attempted to address these early-use deformations by adjusting the manganese steel composition to introduce harder carbide particles into the microstructure of the manganese steel. These compositions typically include a higher carbon content and metallic additives to form the carbide particles, for example vanadium carbide (VC). However, these carbide particles tend to form along the grain boundaries of the ferrous matrix, which significantly reduces the toughness properties of the manganese steel.

SUMMARY OF THE INVENTION

It is an object of the present invention to overcome or ameliorate at least one of the disadvantages of the prior art, or to provide a useful alternative.

According to a first aspect of the invention, there is provided a manganese steel alloy having a heat-treated microstructure comprising:

(a) an alloy composition of:
- manganese: 12 to 30 wt %;
- carbon: 1.0 to 2.0 wt %;
- chromium: 4.5 to 7.0 wt %;
- molybdenum 0.0 to 3.0 wt %; and
- iron and impurities: balance, and (b) an austenitic ferrous matrix, and (c) formed refractory particles throughout the austenitic ferrous matrix such that ≥10% of the formed refractory particles are located within crystallites of the austenitic ferrous matrix, as opposed to being located at grain boundaries between the crystallites, wherein the formed refractory particles are compounds of carbides and/or borides and/or nitrides of any one or more of chromium, zirconium, hafnium, tantalum, molybdenum, and tungsten.

The formed refractory particles may be formed during manufacture of the manganese steel alloy by conventional means, for example precipitation.

In certain embodiments, additional carbon and/or boron and/or nitrogen are added to the composition during manufacture. In further embodiments, the amount of added carbon and/or boron and/or nitrogen is selected to promote the formation of the refractory particles.

In further embodiments, ≥15%, ≥20%, ≥25%, ≥30%, ≥35%, ≥40%, ≥45%, ≥50%, ≥55%, ≥60%, ≥65%, ≥70%, ≥75%, ≥80%, ≥85%, ≥90%, or ≥95% of the formed refractory particles are located within crystallites of the austenitic ferrous matrix, as opposed to being located at grain boundaries between the crystallites.

In certain embodiments, the alloy composition comprises manganese between about 12 wt % and 26 wt %.

In further embodiments, the alloy composition comprises manganese within a range wherein the lower bound is (wt %): 12; 13; 14; 15; 16; 17; 18; 19; 20; 21; 22; 23; 24; 25; 26; 27; 28; or 29; and the upper bound is (subject to the lower bound) (wt %): 29; 28; 27 26; 25; 24; 23; 22; 21; 20; 19; 18; 17; 16; 15; 14; or 13.

In certain embodiments, the alloy composition comprises carbon between about 1.25 wt % and 1.50 wt %.

In further embodiments, the alloy composition comprises carbon within a range wherein the lower bound is (wt %): 1.00; 1.05; 1.10; 1.15; 1.20; 1.25; 1.30; 1.35; 1.40; 1.45; 1.50; 1.55; 1.60; 1.65; 1.70; 1.75; 1.80; 1.85; 1.90; or 1.95; and the upper bound is (subject to the lower bound) (wt %): 2.00; 1.95; 1.90; 1.85; 1.80; 1.75; 1.70; 1.65; 1.60; 1.55; 1.50; 1.45; 1.40; 1.35; 1.30; 1.25; 1.20; 1.15; 1.10; or 1.05.

In certain embodiments, the alloy composition comprises chromium between about 5 wt % and 6 wt %.

In further embodiments, the alloy composition comprises chromium within a range wherein the lower bound is (wt %): 4.5; 4.6; 4.7; 4.8; 4.9; 5.0; 5.1; 5.2; 5.3; 5.4; 5.5; 5.6; 5.7; 5.8; 5.9; 6.0; 6.1; 6.2; 6.3; 6.4; 6.5; 6.6; 6.7; 6.8; or 6.9; and the upper bound is (subject to the lower bound) (wt %): 7.0; 6.9; 6.8; 6.7; 6.6; 6.5; 6.4; 6.3; 6.2; 6.1; 6.0; 5.9; 5.8; 5.7; 5.6; 5.5; 5.4; 5.3; 5.2; 5.1; 5.0; 4.9; 4.8; 4.7; or 4.6.

In certain embodiments, the alloy composition comprises chromium more than 5 wt % and less than or equal to 7 wt %.

In further embodiments, the alloy composition comprises chromium within a range being more than (wt %) 4.0; 4.1; 4.2; 4.3; 4.4; 4.5; 4.6; 4.7; 4.8; 4.9; or 5; and the upper bound is (wt %): 7.0; 6.9; 6.8; 6.7; 6.6; 6.5; 6.4; 6.3; 6.2; 6.1; 6.0; 5.9; 5.8; 5.7; 5.6; 5.5; 5.4; 5.3; 5.2; or 5.1.

In certain embodiments, the alloy composition comprises molybdenum between about 0.5 wt % and 2.0 wt %.

In further embodiments, the alloy composition comprises molybdenum within a range wherein the lower bound is (wt %): 0.0; 0.1; 0.2; 0.3; 0.4; 0.5; 0.6; 0.7; 0.8; 0.9; 1.0; 1.1; 1.2; 1.3; 1.4; 1.5; 1.6; 1.7; 1.8; 1.9; 2.0; 2.1; 2.2; 2.3; 2.4; 2.5; 2.6; 2.7; 2.8; or 2.9; and the upper bound is (subject to the lower bound) (wt %): 3.0; 2.9; 2.8; 2.7; 2.6; 2.5; 2.4; 2.3; 2.2; 2.1; 2.0; 1.9; 1.8; 1.7; 1.6; 1.5; 1.4; 1.3; 1.2; 1.1; 1.0; 0.9; 0.8; 0.7; 0.6; 0.5; 0.4; 0.3; 0.2; or 0.1.

In further embodiments, the alloy composition comprises molybdenum less than, or less than or equal to, (wt %): 2.9; 2.8; 2.7; 2.6; 2.5; 2.4; 2.3; 2.2; 2.1; 2.0; 1.9; 1.8; 1.7; 1.6; 1.5; 1.4; 1.3; 1.2; 1.1; 1.0; 0.9; 0.8; 0.7; 0.6; 0.5; 0.4; 0.3; 0.2; or 0.1.

In certain embodiments, ≥50% of the formed refractory particles are chromium carbides and/or borides and/or nitrides.

In further embodiments, ≥55%, ≥55%, ≥60%, ≥65%, ≥70%, ≥75%, ≥80%, ≥85%, ≥90%, or ≥95% of the formed refractory particles are chromium carbides and/or borides and/or nitrides.

In further embodiments, ≥50%, ≥55%, ≥60%, ≥65%, ≥70%, ≥75%, ≥80%, ≥85%, ≥90%, or ≥95% of the formed refractory particles are chromium carbides.

In certain embodiments, the impurities include one or more of:

silicon: ≤1.00 wt %;
sulphur: ≤0.20 wt %;
nickel: ≤0.15 wt %;
boron: ≤0.10 wt %;
tungsten: ≤0.10 wt %;
phosphorus: ≤0.05 wt %;
copper: ≤0.05 wt %;
titanium: ≤0.05 wt %; and
vanadium: ≤0.05 wt %.

In further embodiments, the impurities may include silicon in concentrations less than or equal to (wt %): 0.90; 0.80; 0.70; 0.60; 0.50; 0.40; 0.30; 0.20; 0.15; 0.10; 0.09; 0.08; 0.07; 0.06; 0.05; 0.04; 0.03; 0.02; or 0.01. In further embodiments, the impurities may include sulphur in concentrations less than or equal to (wt %): 0.15; 0.10; 0.09; 0.08; 0.07; 0.06; 0.05; 0.04; 0.03; 0.02; or 0.01. In further embodiments, the impurities may include nickel in concentrations less than or equal to (wt %): 0.10; 0.09; 0.08; 0.07; 0.06; 0.05; 0.04; 0.03; 0.02;

or 0.01. In further embodiments, the impurities may include boron and/or tungsten in concentrations less than or equal to (wt %): 0.09; 0.08; 0.07; 0.06; 0.05; 0.04; 0.03; 0.02; or 0.01. In further embodiments, the impurities may include phosphorus, copper, titanium and/or vanadium in concentrations less than or equal to (wt %): 0.04; 0.03; 0.02; or 0.01.

In certain embodiments, ≤50% of the formed refractory particles are molybdenum carbides and/or borides and/or nitrides.

In further embodiments, ≤45%, ≤40%, ≤35%, ≤30%, ≤25%, ≤20%, ≤15%, ≤10%, or ≤5% of the formed refractory particles are molybdenum carbides and/or borides and/or nitrides.

In further embodiments, ≤45%, ≤40%, ≤35%, ≤30%, ≤25%, ≤20%, ≤15%, ≤10%, or ≤5% of the formed refractory particles are molybdenum carbides.

In certain embodiments, the formed refractory particles are compounds of carbides and/or borides and/or nitrides of chromium and any one or more of zirconium, hafnium, tantalum, molybdenum, and tungsten.

In certain embodiments, the manganese steel alloy comprises ≤10 wt % carbides and/or borides and/or nitrides of zirconium, hafnium, tantalum, and tungsten. In further embodiments, the manganese steel alloy comprises ≤9 wt %, ≤8 wt %, ≤7 wt %, ≤6 wt %, ≤5 wt %, ≤4 wt %, ≤3 wt %, ≤2 wt %, ≤1.5 wt %, ≤1 wt %, ≤0.9 wt %, ≤0.8 wt %, ≤0.7 wt %, ≤0.6 wt %, ≤0.5 wt %, ≤0.4 wt %, ≤0.3 wt %, ≤0.2 wt %, or ≤0.1 wt % carbides and/or borides and/or nitrides of zirconium, hafnium, tantalum, and tungsten.

In certain embodiments, the alloy composition carbon is selected based on the concentration of manganese to control properties the microstructure including one or more of:

increasing a rate of formed refractory particles forming throughout the austenitic ferrous matrix, opposed to being localized at grain boundaries;
decreasing a rate of formed refractory particles forming at grain boundaries of the austenitic ferrous matrix;
increasing a rate of formed refractory particles forming with smooth surfaces;
reducing a rate of formed refractory particles forming with coarse surfaces; and/or
reducing a rate of grain growth within the austenitic ferrous matrix.

In certain embodiments, the formed carbides comprise a maximum of 1.0 wt % titanium carbides, niobium carbides and/or vanadium carbides.

In further embodiments, the formed carbides comprise a maximum of 0.9 wt %, 0.8 wt %, 0.7 wt %, 0.6 wt %, 0.5 wt %, 0.4 wt %, 0.3 wt %, 0.2 wt % or 0.1 wt % titanium carbides, niobium carbides and/or vanadium carbides.

In certain embodiments, the manganese steel alloy is a cast alloy.

In certain embodiments, the manganese steel alloy is a casting that is heat-treated by solution treatment and quenching.

In certain embodiments, the solution treatment occurs at a temperature between about 1000° C. and 1250° C.

In further embodiments, the solution treatment occurs at a temperature between about: 1050° C. and 1250° C.; 1100° C. and 1250° C.; 1100° C. and 1200° C.; or 1150° C. and 1200° C.

In certain embodiments, the solution treatment occurs at a temperature greater than about 1050° C.

In certain embodiments, the solution treatment occurs at a temperature greater than about 1150° C.

In further embodiments, the solution treatment occurs at a temperature greater than: 1060° C.; 1070° C.; 1080° C.; 1090° C.; 1100° C.; 1110° C.; 1120° C.; 1130° C.; 1140° C.; 1150° C.; 1160° C.; 1170° C.; 1180° C.; 1190° C.; or 1200° C.

In certain embodiments, the solution treatment occurs at a temperature of about 1170° C.

In further embodiments, the solution treatment occurs at a temperature of about: 1050° C.; 1060° C.; 1070° C.; 1080° C.; 1090° C.; 1100° C.; 1110° C.; 1120° C.; 1130° C.; 1140° C.; 1150° C.; 1160° C.; 1170° C.; 1180° C.; 1190° C.; or 1200° C.

In certain embodiments, the quenching is with water.

In further embodiments, the quenching is with: an oil; or a brine.

In certain embodiments, the manganese steel alloy is a wrought alloy.

According to a second aspect of the invention, there is provided equipment adapted for high-stress gouging abrasion that includes the manganese steel alloy of the invention.

In certain embodiments, the equipment is a liner selected from cone crusher liners, gyratory crusher liners, jaw crusher liners, impact crusher liners, mill liners, and other liners used in the mining industry, or a wear part used in crusher systems and mill systems.

According to a third aspect of the invention, there is provided a method of producing the manganese steel alloy of the invention, comprising the steps of:

(a) forming a melt of a manganese steel comprising heating a composition to a casting temperature, the composition comprising:
manganese: 12 to 30 wt %;
carbon: 1.0 to 2.0 wt %;
chromium: 4.5 to 7.0 wt %;
molybdenum: 0.0 to 3.0 wt %; and
iron and impurities: balance, and
(b) pouring the melt into a mould to form the casting;
(c) allowing the casting to cool to room temperature;

(d) heating the casting to a solution treatment temperature; and (e) quenching the casting.

In certain embodiments, the casting temperature is between about 1350° C. and 1450° C.

In further embodiments, the casting temperature is between about: 1350° C. and 1400° C.; 1350° C. and 1390° C.; 1360° C. and 1390° C.; 1360° C. and 1380° C.; or 1370° C. and 1380° C.

In certain embodiments, the casting temperature is within 30° C. of a liquidus temperature of the melt of manganese steel.

In further embodiments, the casting temperature is within 20° C., 10° C., or 5° C. of a liquidus temperature of the melt of manganese steel.

In certain embodiments, the solution treatment temperature is between about 1000° C. and 1250° C.

In further embodiments, the solution treatment temperature is between about: 1050° C. and 1250° C.; 1100° C. and 1250° C.; 1100° C. and 1200° C.; or 1150° C. and 1200° C.

In certain embodiments, the solution treatment temperature is greater than about 1050° C.

In certain embodiments, the solution treatment temperature is greater than about 1150° C.

In further embodiments, the solution treatment temperature is greater than about: 1060° C.; 1070° C.; 1080° C.; 1090° C.; 1100° C.; 1110° C.; 1120° C.; 1130° C.; 1140° C.; 1150° C.; 1160° C.; 1170° C.; 1180° C.; 1190° C.; or 1200° C.

In certain embodiments, the solution treatment temperature is about 1170° C.

In further embodiments, the solution treatment occurs at a temperature of about: 1050° C.; 1060° C.; 1070° C.; 1080° C.; 1090° C.; 1100° C.; 1110° C.; 1120° C.; 1130° C.; 1140° C.; 1150° C.; 1160° C.; 1170° C.; 1180° C.; 1190° C.; or 1200° C.

In certain embodiments, the quenching is with water.

In further embodiments, the quenching is with: an oil; or a brine.

Other aspects, features, and advantages will become apparent from the following Detailed Description when taken in conjunction with the accompanying drawings, which are a part of this disclosure and which illustrate, by way of example, principles of the various embodiments.

BRIEF DESCRIPTION OF DRAWINGS

Preferred embodiments of the invention will now be described, by way of example only, with reference to the accompanying drawings in which.

DETAILED DESCRIPTION

The following embodiments are described by way of example only in order to provide a more detailed understanding of certain aspects of the invention. It is to be understood that other embodiments are contemplated, and it is not intended that the disclosed invention is limited to the following description. Specifically, while the following examples have been directed to manganese steel castings with carbide refractory particles, it will be appreciated that manganese steels produced with alternative methods could demonstrate similar properties, e.g. wrought manganese steels with boride refractory particles.

The inventor has carried out extensive experimental work in relation to the manganese steel casting of the present invention to determine the limits of composition concentrations that would enable the sought carbide structures that are dispersed throughout the austenitic ferrous matrix, rather than the carbides amassing at the grain boundaries. Moreover, the inventor has further investigated varying production methodology variables in order to maximize the dispersed carbides and minimize the carbides at the grain boundaries, particularly in relation to heat-treatment of the steel.

The inventor has found that the produced manganese steel with dispersed carbides throughout the matrix possesses an increased hardness when compared to conventional manganese steels with a higher proportion of carbides localized at the grain boundaries. The manganese steel according to the invention provides further advantages in being less susceptible to cracking at grain boundaries when compared to conventional manganese steels.

Figure 1:
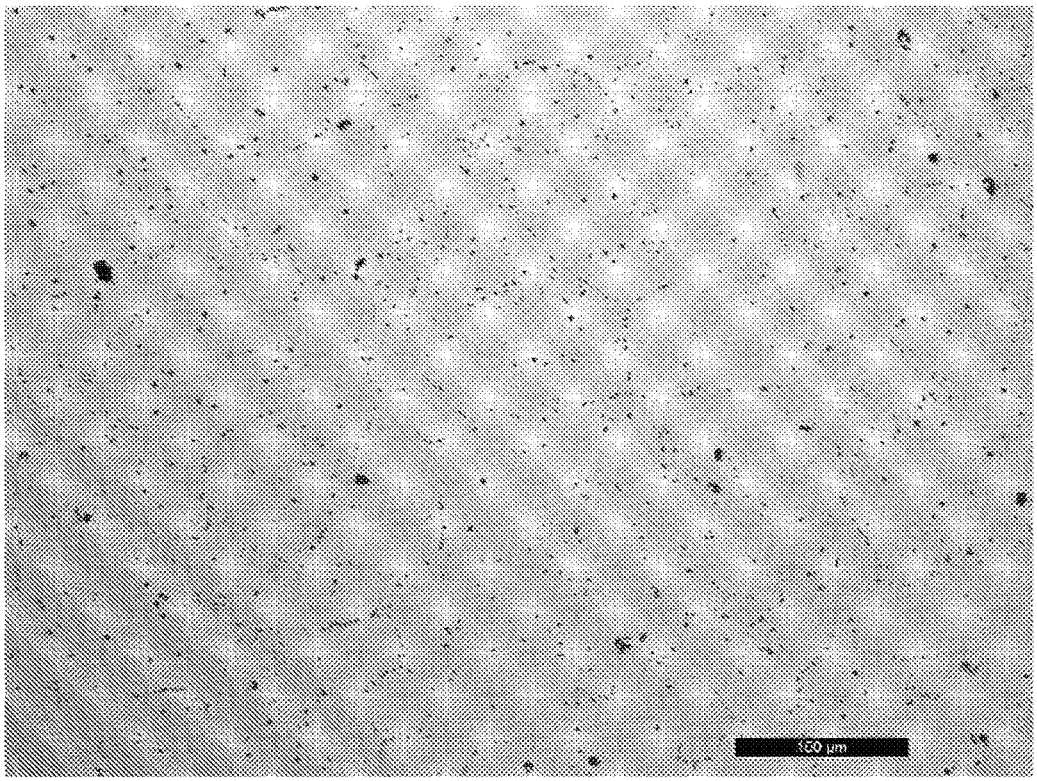
FIG. 1 illustrates a microstructure of an example manganese steel casting of the invention, showing the dispersion of fine Cr-rich carbide particles.

A produced microstructure of an example manganese steel casting of the invention is provided in FIG. 1, illustrating the dispersion of fine Cr-rich carbide particles.

The broadest composition concentration ranges of the manganese steel casting include:

manganese: 12 to 30 wt %;

carbon: 1.0 to 2.0 wt %;

chromium: 4.5 to 7.0 wt %; and iron and impurities: balance.

This manganese steel may also include a small concentration of molybdenum, which is known to suppress pearlite formation during the manufacturing process. The formation of pearlites in the manganese steel is undesirable as it results in a more brittle alloy. In particular, the inventor has proposed the addition of molybdenum in concentrations less than 3 wt %, preferably between about 0.5 to 2.0 wt %.

In particular embodiments the inventor sought to enhance the initial hardness of the manganese steel casting while also maintaining the high toughness and work-hardening capabilities typical of conventional manganese steels. In this regard, the inventor pursued compositions with a higher manganese content than that of a conventional manganese steel and adjusted the carbon and chromium contents accordingly to meet the sought properties. During this process, the inventor further found that the carbon and chromium contents could be optimized to provide greater control of the microstructure of the manganese steel, in particular to:

promote the carbide particles to form throughout the ferrous matrix (opposed to being localized at the grain boundaries);

produce smoother carbide particles (relative to coarser carbide particles formed in conventional manganese steels); and control the grain size of the ferrous matrix.

EXAMPLES

Two example manganese steel castings were prepared in accordance with the invention and designated as H8765ST and H8766ST. The chemical compositions of these samples are provided under Table 1. These castings were poured and moulded at about 1370-1450° C. (H8765ST around 1370° C., H8766ST around 1450° C.) and allowed to cool. It is noted that carbide particles are formed throughout the alloy structure during this cooling process, including both dispersed particles in the ferrous matrix and particles at the grain boundaries.

The castings of the invention were then solution-treated at a temperature of about 1150-1180° C. and immediately quenched in water. The selected solution-treatment temperature range, being increased over conventional solution-treatment temperatures, was selected by the inventor through an experimental process. In particular, the inventor found that an increased solution-treatment temperature promoted the dissolution of grain boundary carbides during solution-treatment; however, the inventor further observed that the increased temperature caused the grain boundaries to shift resulting in grain growth, particularly undesirable coarse grain growth. The particular temperature range was accordingly selected, further in view of the alloy composition and matrix structure, to maximize discrete fine-grain carbide particles dispersed throughout the ferrous matrix and minimize the grain boundary carbides.

Table 1 further details the chemical compositions of two comparative samples of conventional manganese steels.

TABLE 1

Chemical compositions of samples

| | Sample 1: H8765ST wt % | Sample 2: H8766ST wt % | Comparative Sample 1: A31 H8609 wt % | Comparative Sample 2: K700 wt % |
|---|---|---|---|---|
| Mn | 17.40 | 17.80 | 12.0 | 12.5 |
| C | 1.37 | 1.42 | 1.15 | 1.20 |
| Cr | 5.20 | 6.20 | <0.01 | <0.01 |
| Fe and impurities | Base | Base | Base | Base |

The samples were tested for their initial hardness (after heat treatment) and subjected to cold-rolling to compare their bulk hardness after strain. This process effectively simulates the increased hardness that could be achieved by work-hardening the samples.

Figure 2:
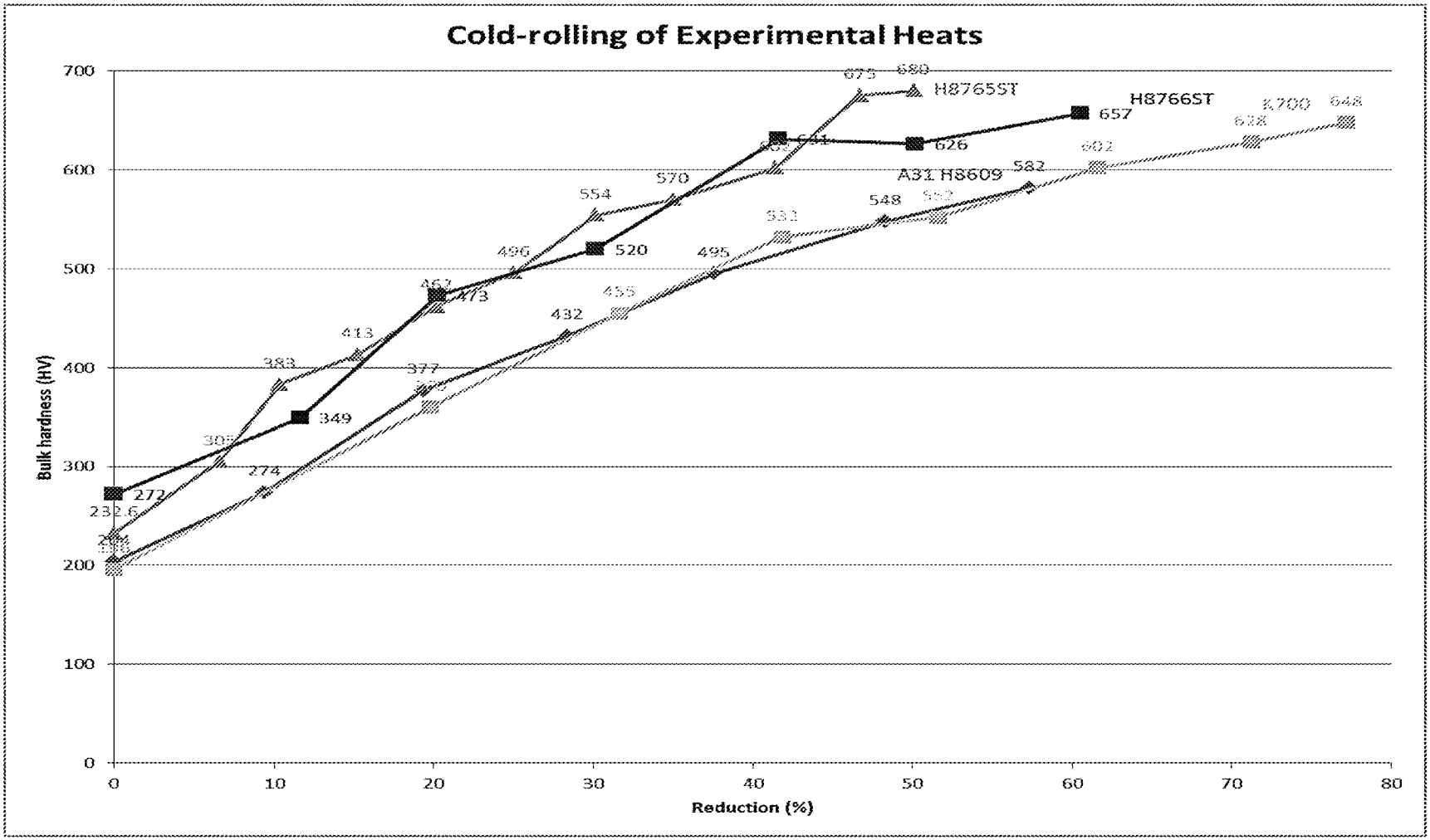
FIG. 2 illustrates a comparison of bulk hardness with increasing levels of cold rolling between two example manganese steel casting of the invention against two conventional manganese steels.

The results of these cold-rolling tests, shown in FIG. 2, demonstrated that the manganese steels produced in accordance with the present invention possessed an increased initial hardness (after heat treatment) compared to the comparative samples, and were able to be work-hardened at a similar rate to the comparative samples, as demonstrated by the extracted points detailed in Table 2:

TABLE 2

Cold-rolling hardness of samples

| | Hardness (HV) | | | |
|---|---|---|---|---|
| Reduction (%) | Sample 1: H8765ST | Sample 2: H8766ST | Comparative Sample 1: A31 H8609 | Comparative Sample 2: K700 |
| 0 | 232.6 | 272 | 204 | 196 |
| 20 | 462 | 473 | −377 | −366 |
| 50 | 680 | 626 | −550 | −550 |

Throughout this specification and the claims which follow, the singular forms "a", "an" and "the" include plural referents unless the context clearly dictates otherwise.

The term "impurity" or "impurities" has been used in throughout the specification and the claims to refer to any compositional element that has not been explicitly defined in the alloy compositions. This may include intentional compositional additives and/or unintentional compositional contaminants from manufacturing.

Furthermore, unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Ranges may be expressed herein as from "about" or "approximately" one particular value and/or to "about" or "approximately" another particular value. When such a range is expressed, other example embodiments include from the one particular value and/or to the other particular value, or to any singular value or value range between the two mentioned values. Moreover, ranges may be expressed herein as "more than", "more than or equal to", "less than" or "less than or equal to" a particular value. When such a range is expressed, other example embodiments include any singular value or subset value range that lies within the initial value range.

Although the invention has been described with reference to specific embodiments, it will be appreciated by those skilled in the art that the invention may be embodied in many other forms. For example, it will be appreciated that many combinations, alterations, modifications, variations and substitutions will be apparent to those skilled in the art without departing from the scope of the present invention, and it is intended for this application to embrace all such combinations, alterations, modifications, variations and substitutions. Moreover, wherein specific integers are mentioned which have known equivalents in the art to which the invention relates, such known equivalents are deemed to be incorporated herein as if individually set forth.

The invention claimed is:

1. A manganese steel alloy having a heat-treated microstructure comprising:

(a) an alloy composition of:
- manganese: 12 to 30 wt %;
- carbon: 1.0 to 2.0 wt %;
- chromium: more than 5 wt % and less than or equal to 7 wt %;
- molybdenum: 0.0 to 3.0 wt %; and
- iron and impurities: balance;

(b) an austenitic ferrous matrix; and (c) formed refractory particles dispersed throughout the austenitic ferrous matrix such that ≥10 wt % of the formed refractory particles are located within crystallites of the austenitic ferrous matrix, as opposed to being located at grain boundaries between the crystallites;

wherein the formed refractory particles are chromium rich carbides, and wherein the impurities include one or more of silicon≤1.00 wt %, sulphur≤0.20 wt %, nickel≤0.15 wt %, boron≤0.10 wt %, tungsten≤0.10 wt %, phosphorus≤0.05 wt %, copper≤0.05 wt %, titanium≤0.05 wt % and vanadium≤0.05 wt %.

2. The manganese steel alloy according to claim 1, wherein the alloy composition comprises manganese between about 12 wt % and 26 wt %.

3. The manganese steel alloy according to claim 1, wherein the alloy composition comprises carbon between about 1.25 wt % and 1.50 wt %.

4. The manganese steel alloy according to claim 1, wherein the alloy composition comprises chromium between 5 wt % and 6 wt %.

5. The manganese steel alloy according to claim 1, wherein the alloy composition comprises molybdenum between about 0.5 wt % and 2.0 wt %.

6. The manganese steel alloy according to claim 1, wherein the alloy composition carbon is selected based on the concentration of manganese to control properties of the microstructure including one or more of:

increasing a rate of formed refractory particles forming throughout the austenitic ferrous matrix, as opposed to being localized at grain boundaries;

decreasing a rate of formed refractory particles forming at grain boundaries of the austenitic ferrous matrix;

increasing a rate of formed refractory particles forming with smooth surfaces;

reducing a rate of formed refractory particles forming with coarse surfaces; and/or reducing a rate of grain growth within the austenitic ferrous matrix.

7. The manganese steel alloy according to claim 1 wherein the manganese steel alloy is a cast alloy.

8. The manganese steel alloy according to claim 7, wherein the manganese steel alloy is a casting that is heat-treated by solution treatment and quenching.

9. The manganese steel alloy according to claim 8, wherein the solution treatment occurs at a temperature between about 1000° C. and 1250° C.

10. The manganese steel alloy according to claim 7 wherein the quenching is with water.

11. A method of producing the manganese steel alloy according to claim 1, comprising the steps of:

(a) forming a melt of a manganese steel comprising heating a composition to a casting temperature, the composition comprising:

manganese: 12 to 30 wt %;

carbon: 1.0 to 2.0 wt %;

chromium: 4.5 to 7.0 wt %;

molybdenum: 0.0 to 3.0 wt %; and iron and impurities: balance, and (b) pouring the melt into a mould to form the casting;

(c) allowing the casting to cool to room temperature;

(d) heating the casting to a solution treatment temperature; and (e) quenching the casting.

12. The method according to claim 11, wherein the casting temperature is between about 1350° C. and 1450° C.

13. The method according to claim 11, wherein the casting temperature is within 30° C. of a liquidus temperature of the melt of manganese steel.

14. The method according to claim 11, wherein the solution treatment temperature is between about 1000° C. and 1250° C.

15. The method according to claim 11, wherein the quenching is with water.

* * * * *